US009618174B2

(12) United States Patent
Jungwirth et al.

(10) Patent No.: US 9,618,174 B2
(45) Date of Patent: Apr. 11, 2017

(54) LED LIGHT-SOURCE MODULE FOR A VEHICLE HEADLIGHT

(75) Inventors: Johannes Jungwirth, Wolfsbach (AT); Andreas Moser, Haag (AT); Günther Krenn, Boheimkirchen (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 50 days.

(21) Appl. No.: 14/237,718

(22) PCT Filed: Jun. 28, 2012

(86) PCT No.: PCT/AT2012/050090
§ 371 (c)(1),
(2), (4) Date: Feb. 21, 2014

(87) PCT Pub. No.: WO2013/020155
PCT Pub. Date: Feb. 14, 2013

(65) Prior Publication Data

US 2014/0169014 A1 Jun. 19, 2014

(30) Foreign Application Priority Data

Aug. 8, 2011 (AT) ..... A 1114/2011

(51) Int. Cl.
*F21S 8/10* (2006.01)

(52) U.S. Cl.
CPC ..... *F21S 48/1154* (2013.01); *F21S 48/1241* (2013.01); *F21S 48/1747* (2013.01)

(58) Field of Classification Search
CPC ..... F21S 48/1154
See application file for complete search history.

(56) References Cited

U.S. PATENT DOCUMENTS

2006/0061286 A1* 3/2006 Coushaine ..... F21K 9/00 315/76
2006/0087861 A1* 4/2006 Tessnow ..... F21S 48/1154 362/538

(Continued)

FOREIGN PATENT DOCUMENTS

DE 10231326 A1 2/2004
EP 2280215 A2 2/2011

(Continued)

OTHER PUBLICATIONS

EP 2280215 English translation.*
International Search Report of PCT/AT2012/050090 dated Aug. 10, 2012.

*Primary Examiner* — Jong-Suk (James) Lee
*Assistant Examiner* — Eric T Eide
(74) *Attorney, Agent, or Firm* — Eversheds Sutherland (US) LLP

(57) ABSTRACT

The invention relates to an LED light-source module (M, M1-M4) for an LED motor vehicle headlight (SW), in particular for an LED motor vehicle headlight (SW) for producing a dynamic light distribution, wherein the LED light-source module (M) comprises two or more LED light sources (LEQ), wherein one LED light source (LEQ) in each case comprises at least one light-emitting diode (LED1, LED2), and wherein the light-emitting diodes (LED1, LED2) of each LED light source (LEQ) couple light into an associated primary optical element (P1-P4), wherein the incoupled light exits, at least partially, through a light exit surface (L1-L4) of the primary optical element (P1-P4), and wherein the light exit surfaces (L1-L4) of the primary optical elements (P1-P4) of an LED light-source module (M) are connected to one another by means of a light-permeable material such that light coupled into the primary optical elements (P1-P4) can enter the light-permeable mate- (Continued)

Figure 1:
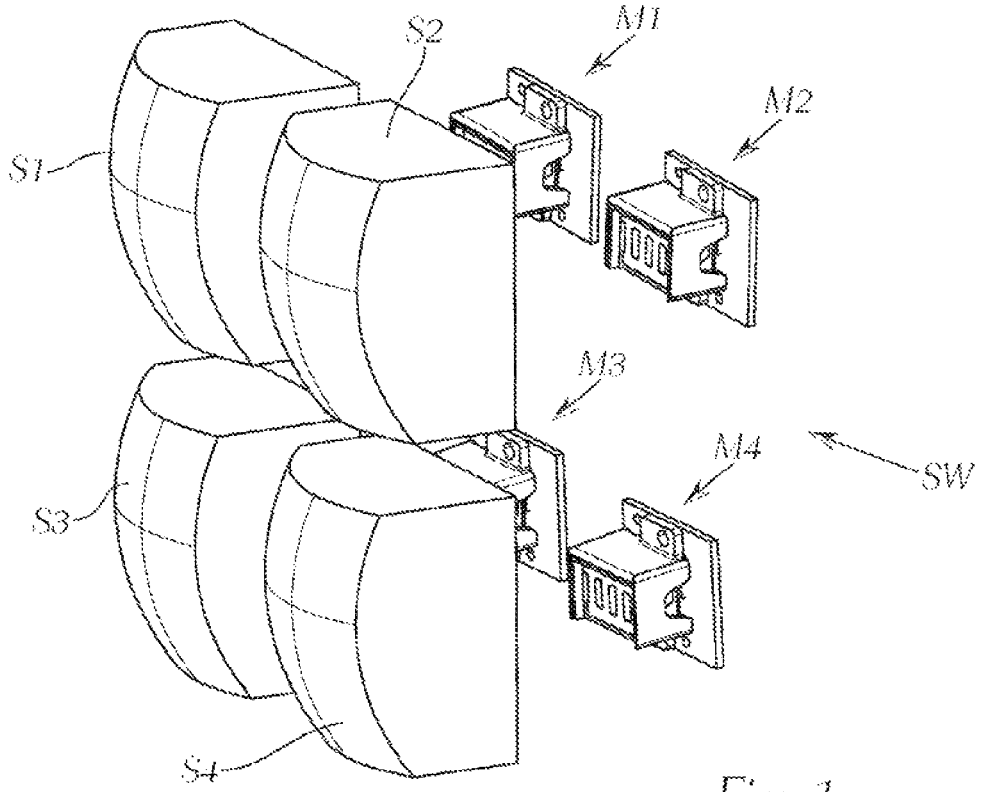

rial and can then exit this material through a light exit surface (LF1, LF2) of the light-permeable material.

32 Claims, 7 Drawing Sheets

(56) References Cited

U.S. PATENT DOCUMENTS

| | | | | |
|---|---|---|---|---|
| 2009/0213606 | A1* | 8/2009 | Coushaine | F21S 48/1154 362/507 |
| 2011/0096562 | A1* | 4/2011 | Lambert | B60Q 1/20 362/545 |
| 2011/0121732 | A1* | 5/2011 | Tsutsumi | F21S 48/1159 315/77 |
| 2013/0114277 | A1 | 5/2013 | Faffelberger | |
| 2013/0215632 | A1 | 8/2013 | Jackl et al. | |
| 2013/0223089 | A1 | 8/2013 | Danner et al. | |
| 2013/0235605 | A1 | 9/2013 | Bohm | |
| 2013/0308329 | A1 | 11/2013 | Danner et al. | |
| 2014/0043843 | A1 | 2/2014 | Moser et al. | |

FOREIGN PATENT DOCUMENTS

| | | | |
|---|---|---|---|
| EP | 2306075 | A2 | 4/2011 |
| WO | 2007027474 | A2 | 3/2007 |
| WO | 2013020156 | A1 | 2/2013 |

* cited by examiner

LED LIGHT-SOURCE MODULE FOR A VEHICLE HEADLIGHT

The invention relates to an LED light-source module for an LED motor vehicle headlight, in particular for an LED motor vehicle headlight for producing a dynamic light distribution, wherein the LED light-source module comprises two or more LED light sources, wherein one LED light source comprises at least one light-emitting diode in each case, and wherein the light-emitting diodes of each LED light source couple light into an associated primary optical element, wherein the incoupled light then exits, at least partially, through a light exit surface of the primary optical element.

The invention furthermore relates to a headlight comprising such an LED light-source module, and to a corresponding headlight system.

Light-emitting diodes are being used to an increasing extent in motor-vehicle construction to implement main-headlight functions, for example to produce dimmed lighting and/or high-beam lighting, but also for other light functions such as highway lighting, adverse-weather lighting, and daytime-driving lighting.

Headlight LED light sources are also particularly well-suited for special applications, for example for illuminating objects, in which only certain LED light sources are visible or emit light, while the remaining LED light sources do not emit light. The application of illuminating objects involves illuminating objects on the side of the road, for example, such as pedestrians or traffic signs, with light, e.g. infrared light, whereupon these objects can be captured by an infrared camera. Visible light can also be used, of course, to illuminate traffic signs, for example.

Conversely, it is also possible, of course, to omit regions of a light distribution, such as a high-beam lighting distribution when oncoming traffic appears, namely specifically those regions of the light distribution that would produce glare for the oncoming traffic, thereby ensuring that this glare is not produced.

The aforementioned tasks can be achieved by the selective activation or, in the latter case, by the selective deactivation of certain LED light sources.

Electronic solutions currently exist for selecting certain LED light sources, in which only certain LED light sources are activated or deactivated, thereby ensuring that only the desired LED light sources emit light onto the road. This solution provides high flexibility, since basically any LED light sources are activated.

Other solutions comprise apertures, which can be brought into an appropriate position in order to block light from certain LED light sources.

The Austrian patent application AT 508604 belonging to the applicant makes known a headlight comprising the initially mentioned LED light-source modules, with which a dynamic light distribution can be produced, which can be adapted to different traffic situations, etc., during driving.

In particular, such a headlight can be developed using conventionally available LED light sources.

Such a headlight makes it possible to implement individual light functions, such as dimmed lighting, high-beam lighting, cornering lighting, etc., using static lighting technology without any moving parts, in that the illuminating surface is divided into separately switchable segments. The light originating from the LEDs is projected onto the roadway via the individual primary optical units, which form the individual segments of the light exit surfaces, and the associated secondary optical units, as the segmented light distribution.

This segmentation produces inhomogeneities in the light distribution, in particular in the far-field region, such as bleeding, strip formation or spots, which have a disruptive effect in the projection onto the ground or road.

A problem addressed by the invention is that of reducing or entirely eliminating unwanted effects in the light pattern, in particular in the projection of the light pattern onto the roadway or ground.

This problem is solved with an initially mentioned LED light-source module in that, according to the invention, the light exit surfaces of the primary optical elements of an LED light-source module are connected to one another by means of a light-permeable material such that light coupled into the primary optical elements can enter the light-permeable material and can then exit this material through a light exit surface of the light-permeable material.

Due to the connection of the individual primary optical elements—the light exit surfaces of which produce the segments in the light pattern—to a light-permeable material, the inhomogeneities in the light pattern fade into one another due to the strip formation, thereby diminishing or completely eliminating the disruptive effects in the light pattern.

In a specific variant of the invention, the light exit surfaces of the primary optical elements lie in a common surface, and the light exit surface of the light-permeable material also lies in the common surface of the light exit surfaces of the primary optical elements.

The common surface is designed either as a plane or curved in accordance with the field curvature of the secondary optical units.

A portion of the light entering a primary optical element is then no longer emitted via the light exit surface of the primary optical element itself, but rather enters the light-permeable material and exits through the light exit surface thereof. As a result, a portion of the light entering the primary optical elements blends and therefore reduces or eliminates the inhomogeneities in the light pattern. The light exiting the light-permeable material therefore contributes to the light distribution.

In order to reduce or eliminate inhomogeneities, it has proven particularly favorable to connect the light exit surfaces of the primary optical elements to one another in an upper and/or lower region.

The primary optical elements are preferably connected to one another in the upper region in every case. The terms "upper" and "lower" refer to the state of the module/headlight installed in the vehicle.

This upper region is imaged via the secondary optical unit in the light pattern below the light-dark boundary, where the unwanted inhomogeneities primarily occur and are most pronounced.

The connection in the lower region is relatively insignificant from an optical perspective and mainly provides mechanical advantages in order to increase the stability of the entire element, which is formed of the individual primary optical elements.

In a specific variant of an LED light-source module, at least one substantially horizontally extending connecting web made of the light-permeable material connects the primary optical elements in the upper and/or lower region of the light exit surfaces thereof.

In particular, exactly two substantially horizontally extending connecting webs made of the light-permeable material connect the primary optical elements to one another in the upper and lower region of the light exit surfaces thereof, wherein the upper web is significant from an optical perspective and a mechanical perspective, while the lower web is significant mainly from a mechanical perspective.

The at least one connecting web is preferably formed as one piece with the light exit surfaces of the primary optical elements or with the primary optical elements, i.e. the individual primary optical elements and the connecting web or connecting webs form a single element, the so-called primary optical unit.

Independently of whether the webs and primary optical elements are connected to one another as one piece or not, it is advantageous when the light exit surfaces of the primary optical elements and those of the at least one connecting web form a common light exit surface, i.e. when they lie in a common plane and are preferably connected to one another without interruption, i.e. without a gap, etc.

In order to achieve optimal optical effects, the at least one connecting web extends upwardly/downwardly in the vertical direction beyond the light exit surfaces of the primary optical elements by a certain, defined height in each case.

The aforementioned also applies when the at least one connecting web extends in the horizontal direction, laterally beyond the light exit surfaces of the primary optical units by a certain length.

It is furthermore advantageous when the at least one connecting web extends in the horizontal direction toward the rear in the direction of the light sources and is connected to the primary optical units along a certain extension.

The design of the connecting web or connecting webs, in particular the extension of the connecting web or connecting webs toward the rear affects the homogeneity of the light pattern, which is also associated with a reduction of the maximum in the light distribution, i.e. the more homogeneous the light pattern is that is selected, the greater the extent is to which the maximum is reduced.

Depending on the desired effects, it is therefore provided that the extension of the at least one connecting web downwardly/upwardly and/or the extension of the at least one connecting web laterally beyond the light exit surfaces of the primary optical elements and/or the extension of the at least one connecting web in the horizontal direction toward the rear, in particular the extension along which the at least one connecting web is connected to the primary optical elements, is/are selected such that the desired extent of homogeneity of the light pattern and the desired extent of the reduction of the maximum in the light distribution are achieved.

A plurality of LED light-source modules is used in a headlight, as described further below. Basically, these have an identical design, to the extent this is possible, and, in particular, these comprise identical primary optical elements or primary optical units (=primary optical elements connected via one or two webs). Basically it can also be provided, however, for optical reasons, that the modules, in particular the primary optical units, and, in this case in particular, the embodiment of the at least one connection web differ from one another, thereby ensuring that the desired light pattern can be adapted in an optimal manner.

Light from the LEDs propagates in the primary optical elements via total internal reflection. In order to ensure that a sufficient quantity of light can enter the light-permeable regions, i.e. the connecting web or connecting webs, it is favorable, as described above, when these are connected to the primary optical units along a certain extension, in the sense of being contacted into one another, preferably being connected to one another, in particular as one piece.

It can also be favorable from an optical perspective when the at least one, in particular the upper connecting web tapers, in the shape of a wedge, for example, in the direction of the light-incoupling points of the primary optical elements.

The wedge shape makes it possible to save material, which lowers costs. This applies, in particular, the further to the rear that the connecting web extends. An embodiment of the connecting web that is cuboid, i.e. not tapered, does not provide any advantages from an optical perspective as compared to the tapered shape, and therefore the latter is advantageously selected.

It can be favorable in particular when the primary optical elements expand from the light-incoupling points thereof toward the light exit surfaces, wherein the primary optical elements expand to a greater extent in the downward extension thereof than in the upward extension thereof.

The primary optical elements have a wedged shaped, for example, wherein the element expands to a greater extent in the downward extension thereof.

Basically, any shapes can be used for the light exit surfaces of the primary optical elements. It has proven favorable for the light exit surfaces of the primary optical elements to be rectangular. Such primary optical units are easy to manufacture and have good optical properties in terms of the superposition of the segments of the light distribution produced by the primary optical unit via the secondary optical units. By means of such light exit surfaces, it is also possible to produce a homogeneous light distribution in the horizontal direction without gaps in the light pattern across the entire height of the light distribution.

For most applications, it is sufficient for all light exit surfaces to have an identical design. This has the advantage that the headlight is easy to calculate and produce, and the costs of the headlight are markedly reduced.

It is also possible, however, to use light exit surfaces having different shapes, e.g. different widths (horizontal expansion). For example, certain regions of the light distribution can be produced having narrower light exit surfaces, thereby resulting in a finer segmentation of the light pattern and making it possible to omit smaller and narrower regions.

It is furthermore favorable when the light exit surfaces of the primary optical elements are disposed parallel to one another and with identical orientation.

The parallel and identical orientation makes it easily possible to also produce a light pattern in the vertical direction and to easily produce a legal light pattern.

It is particularly advantageous when the light exit surfaces of the primary optical elements of an LED light-source module are disposed next to one another with horizontal separation.

Such an arrangement can be implemented in practical applications without particular difficulty, and the light exit surfaces therefore form images of sharply delineated segments in the light pattern via the secondary optical unit, wherein the superposition of these segments forms the overall light pattern. In such an arrangement, defined regions in the light pattern can be omitted in an optimal manner by switching off one or more LED light sources.

As discussed above, a secondary optical unit is associated with each LED light-source module, wherein, when the headlight is installed in a vehicle, this secondary optical unit images the light segments produced by the light exit surfaces of the primary optical elements in a region located in front of the vehicle.

Due to the arrangement of the LED light sources, according to the invention, in two or more LED light-source modules, it is possible to produce a homogeneous light distribution, e.g. a high-beam light distribution, by placing the individual light segments next to one another horizontally in a row and/or superposing the individual light segments, wherein very specific regions of the light distribution can be "omitted", i.e. prevented from illuminating, in this light distribution by switching off one or more LED light sources in order to avoid producing glare for oncoming traffic, for example.

The individual light segments can be disposed directly adjacent to one another in the horizontal direction, for example. In order to prevent excessively abrupt transitions or to ensure that edges do not appear in the light distribution, it is also possible to superpose one or more additional light segments in such regions of adjacent light segments. This also has the advantage in that, by omitting two light segments, for example, it is possible to "omit" regions of the light distribution that are narrower than one light segment, or to prevent these regions from illuminating, wherein this will be discussed in greater detail below.

In a specific form, the light exit surfaces are oriented upright in the vertical direction, having a greater height than width, e.g. these are in the form of rectangles or ellipses.

By means of this upright form having a greater height and a smaller width, one light exit surface illuminates a narrow angular range in the horizontal direction, wherein, in the vertical direction, the entire region can be illuminated with this one light exit surface for this horizontal angular range.

It is particularly advantageous for adjacent light exit surfaces of the primary optical elements of an LED light-source module to have a normal separation from one another, wherein this normal separation corresponds to the width of one light exit surface, and, preferably, for a first overall arrangement of the light exit surfaces to assume a first defined position relative to the optical axis of the secondary optical unit thereof, and wherein a second/third/fourth . . . nth overall arrangement relative to the optical axis of the secondary optical unit thereof is shifted in comparison to the first overall arrangement by one-half/one/two/four/((n−1)/2) times the normal separation (A) between two adjacent light exit surfaces of an LED light-source module.

The result is an arrangement in which—except for the horizontal edge regions—a sharply defined region corresponding to one-half the width of a light exit surface can be omitted by omitting two light sources from the entire headlight.

In a specific, tested embodiment of the invention, in the case of three or more primary optical elements, the separations between light exit surfaces of adjacent primary optical elements are identical and, preferably, all separations between the light exit surfaces of adjacent LED light sources are identical across the entire headlight.

This results in a simple design having identical modules, by means of which a homogeneous light distribution can be achieved.

An LED motor vehicle headlight according to the invention for producing a dynamic light distribution comprises two or more LED light-source modules as described above, wherein a secondary optical unit is associated with each of the LED light-source modules, wherein, when the headlight is installed in a vehicle, this secondary optical unit images the light segments produced by the light exit surfaces of the primary optical elements in a region located in front of the vehicle.

It is furthermore advantageous when the secondary optical elements of the LED light-source modules and the arrangement of the light exit surfaces of the primary optical elements are matched to one another such that the light segments from the individual LED light-source modules are imaged such that these are offset relative to one another in the horizontal direction, and wherein the individual LED light sources can be controlled separately.

A simple, low-cost design of the headlight is obtained when the individual LED light-source modules comprise identical secondary optical elements.

Preferably, all separations between light exit surfaces of adjacent LED light sources are identical across the entire headlight, thereby resulting in a simple design having identical modules, by means of which the most homogeneous light distribution possible can be achieved.

Briefly it is pointed out here that "homogeneous" is not intended to mean that the light pattern is equally bright everywhere over the illuminated region, but rather that, within the light pattern, the transitions between regions having different levels of brightness are constant, and no abrupt transitions occur. The overall light pattern should not be "spotty", but rather should have flowing transitions from lighter to darker regions.

The light pattern can be markedly improved further by means of the present invention.

It is furthermore specifically provided that the overall arrangement of the light exit surfaces of an LED light-source module assumes a defined position in the horizontal direction relative to the optical axis of the secondary optical element, and that the different overall arrangements of the individual LED light-source modules have defined positions differing from one another in the horizontal direction relative to the optical axis of the particular secondary optical element associated therewith.

It can be provided that the light exit surfaces of all LED light-source modules of the headlight are each disposed on one side of a vertical plane through the optical axis of the particular secondary optical unit associated therewith.

It can also be provided that exactly one light exit surface of all light exit surfaces of a headlight intersects the optical axis of the secondary optical unit associated therewith.

Therein, one LED light source comprises at least two light-emitting diodes disposed horizontally over one another, wherein these light-emitting diodes can be controlled independently of one another, and wherein each of the at least two light-emitting diodes is imaged via the light exit surface of the primary optical element as horizontal light segments within the vertical light segment imaged by the primary optical element.

Preferably, each light-emitting diode of an LED light source can be controlled separately.

In a vehicle headlight system according to the invention comprising two headlights, the headlight that is installed in the vehicle on the left produces the left part of the light distribution on the roadway, and the right headlight produces the right part of the light distribution, and wherein at least each LED light source, preferably each light-emitting diode of the two headlights, can be controlled separately.

Figure 2:
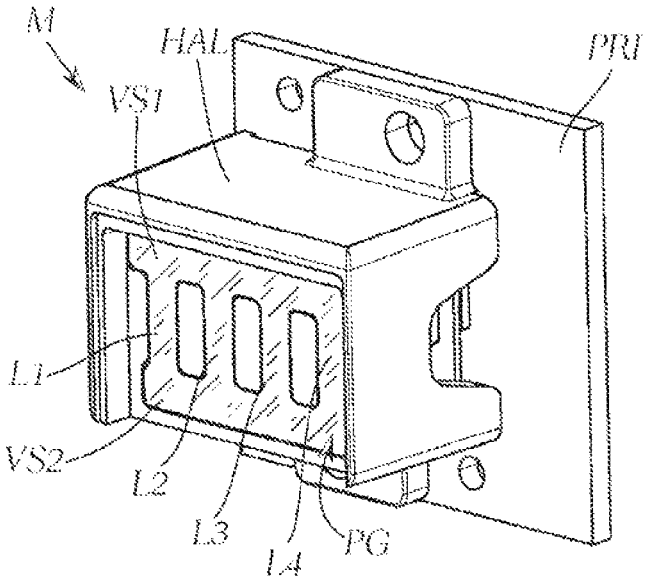
Figure 3:
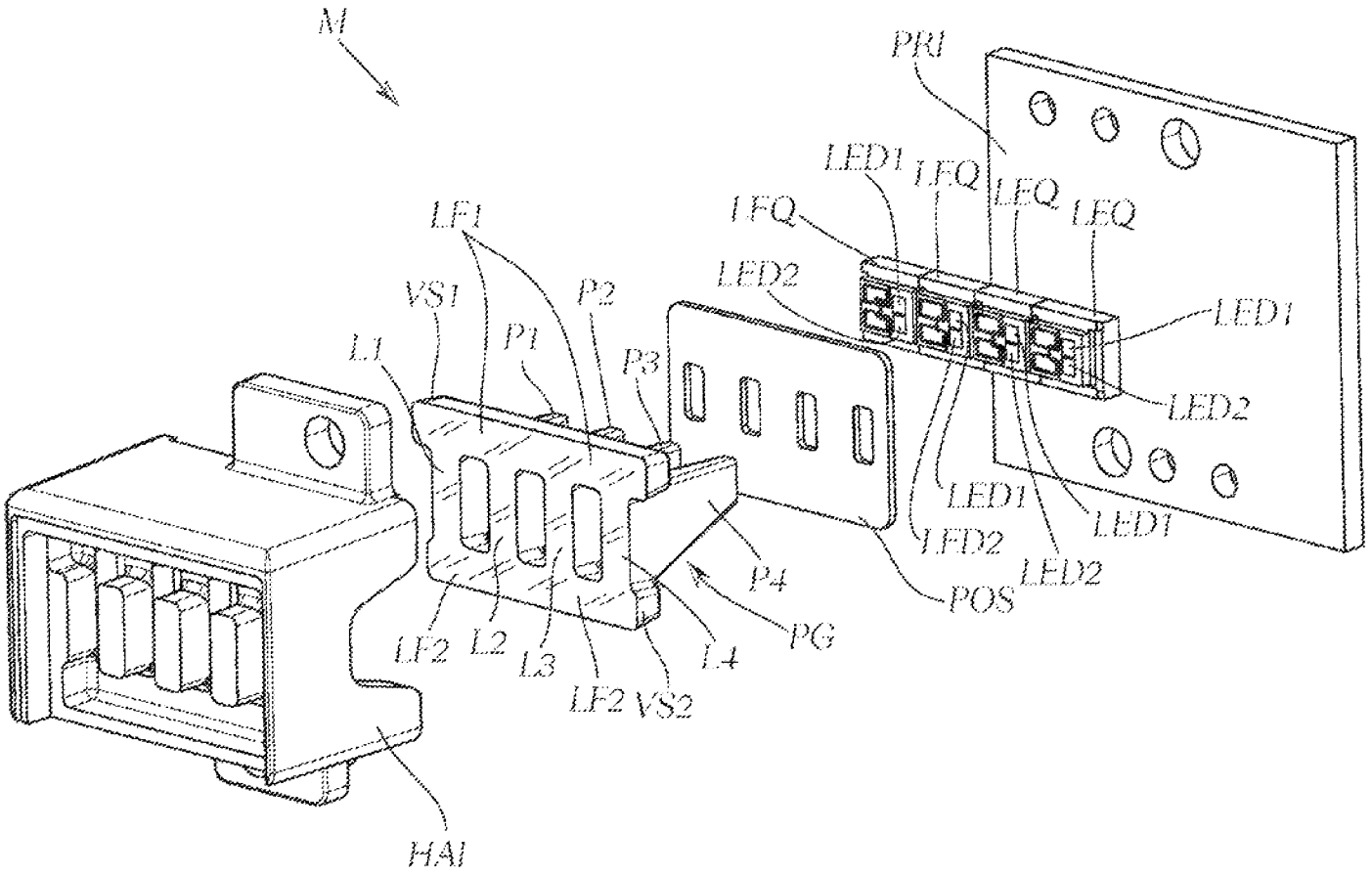
Figure 4:
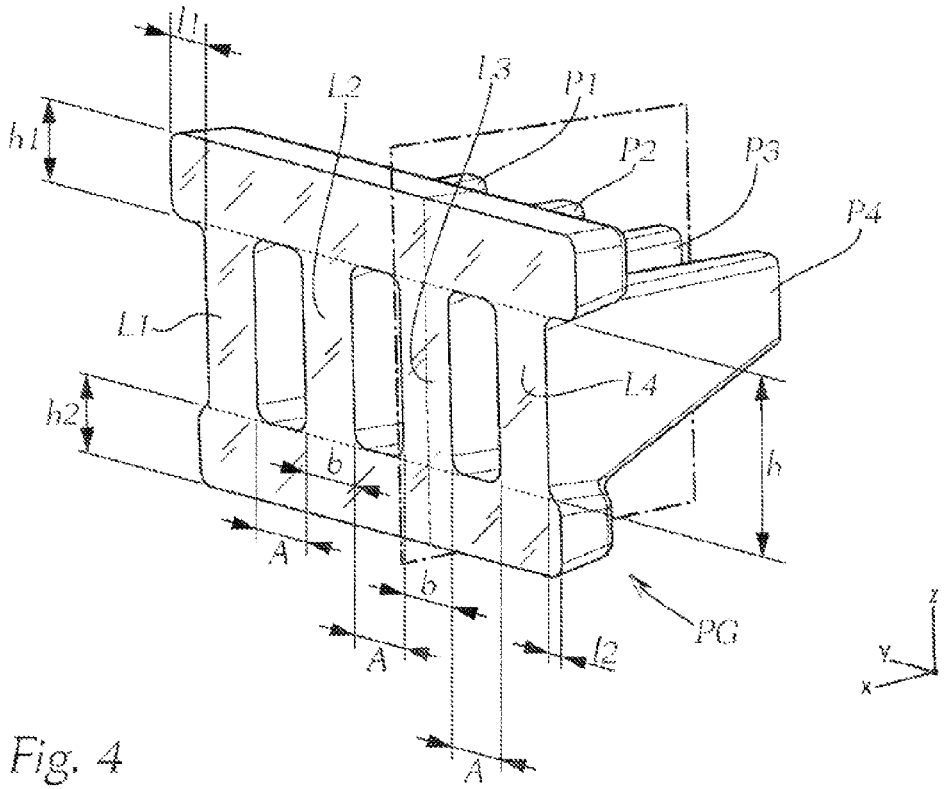
Figure 5:
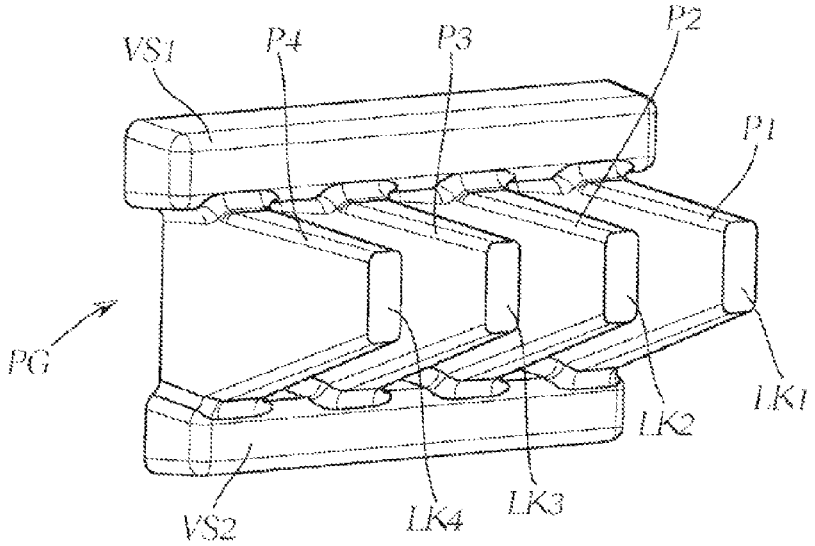
Figure 6:
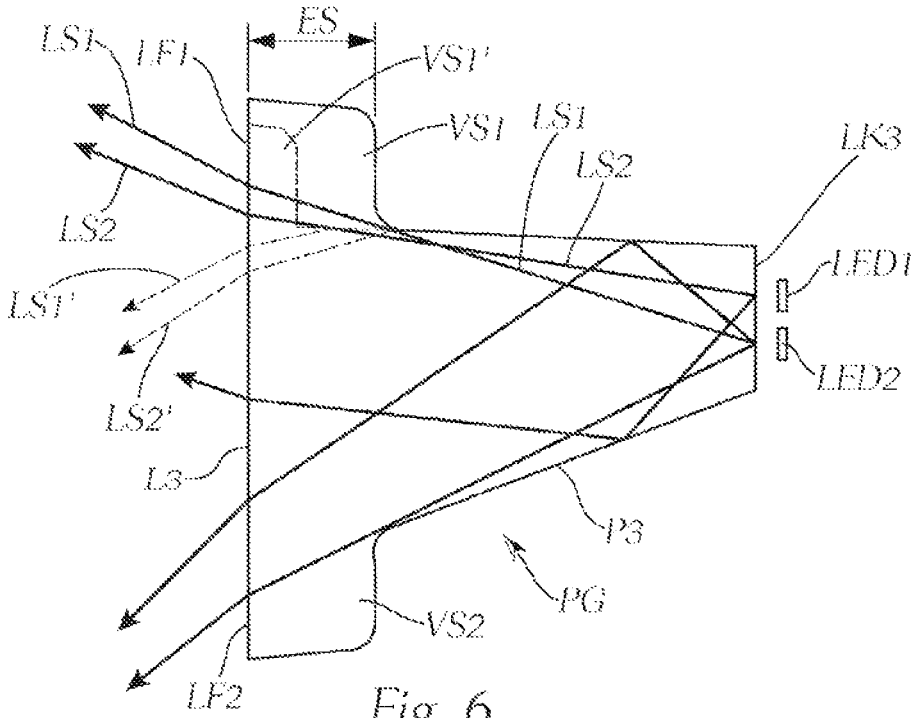
Figure 7:
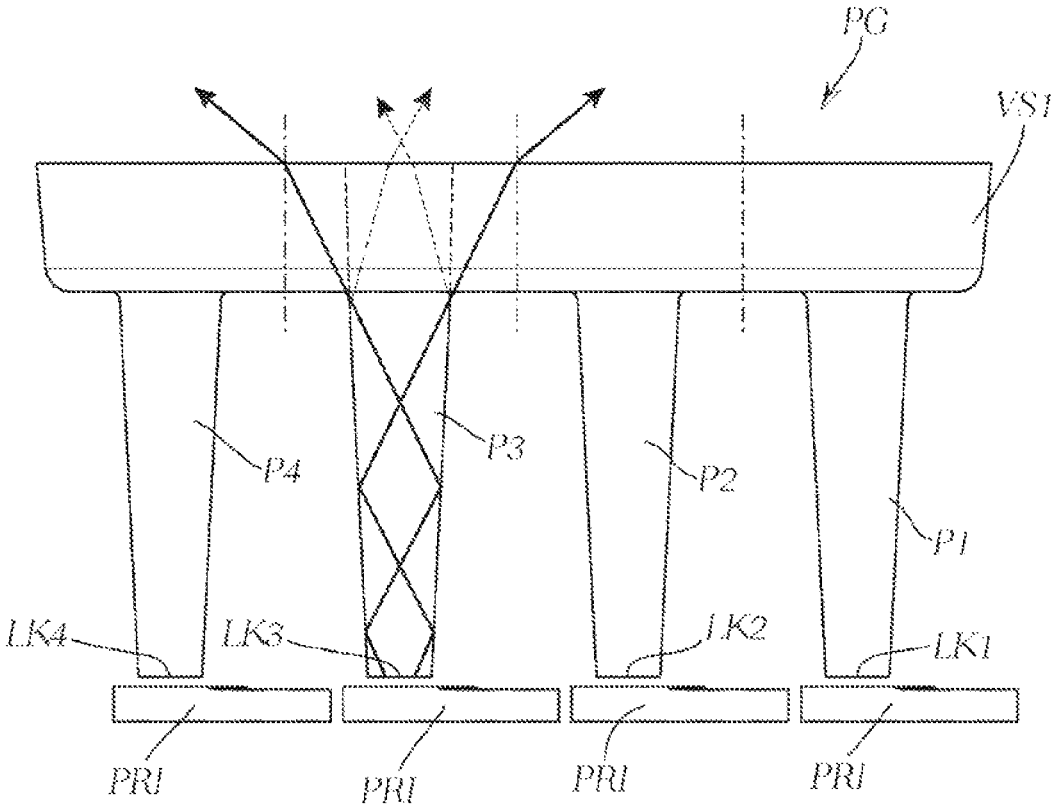
Figure 8:
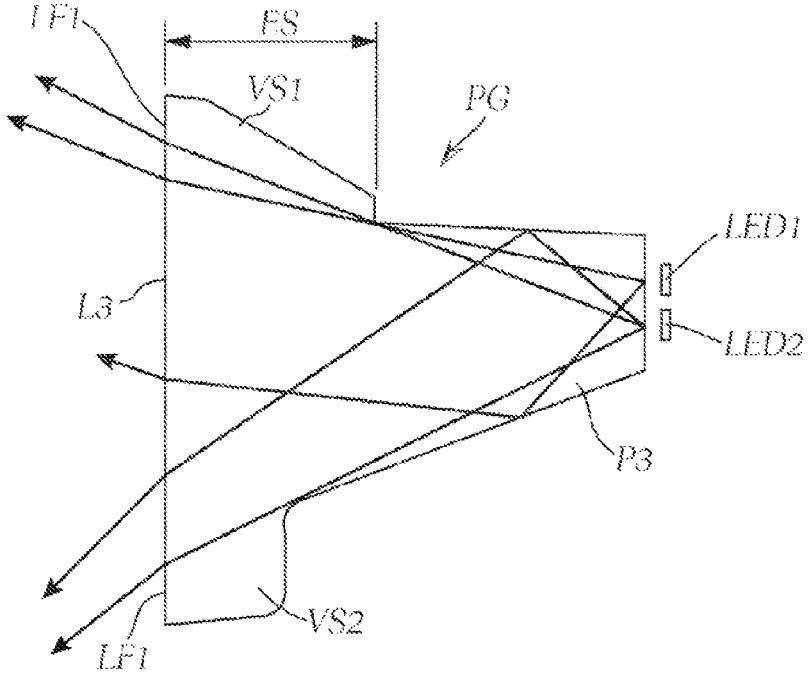
Figure 9:
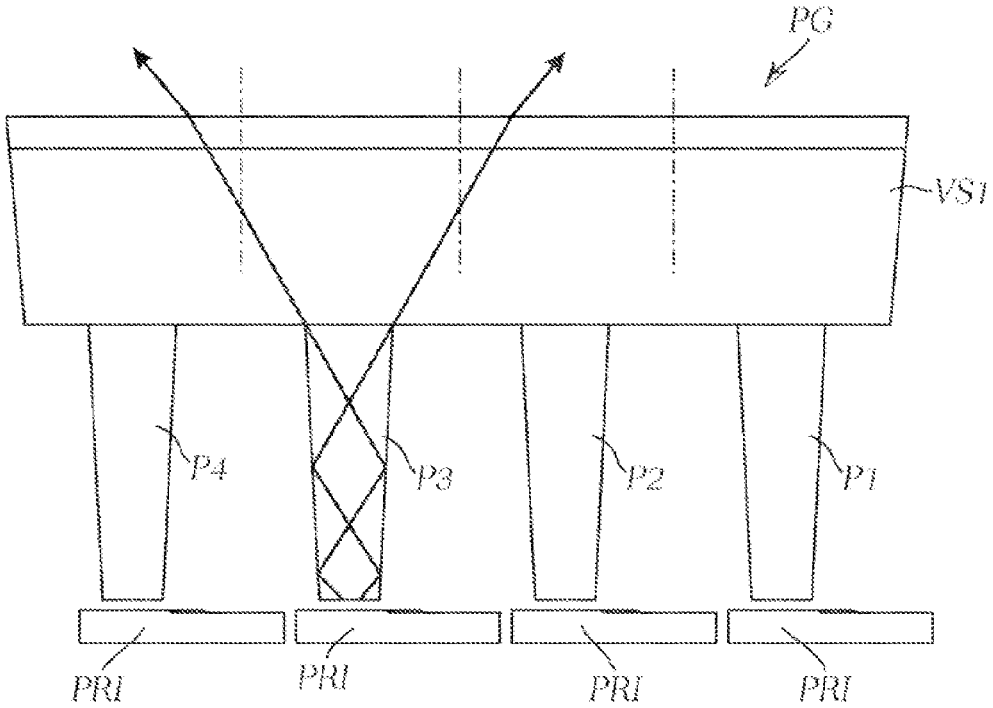
Figure 10:
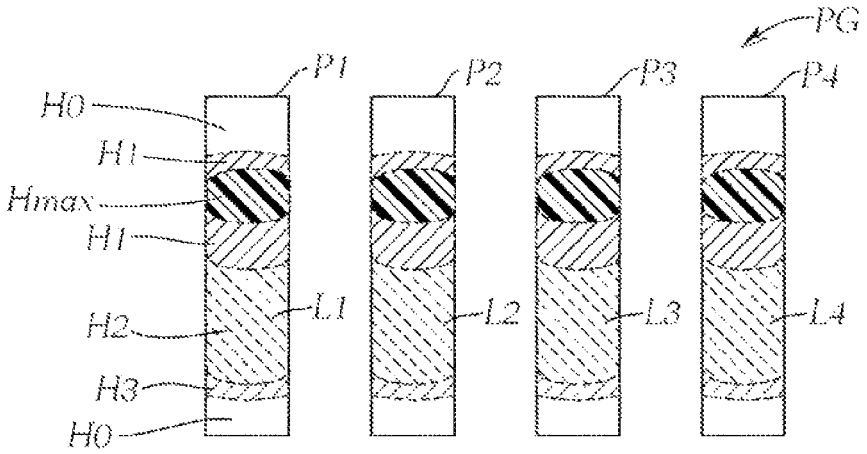
Figure 11:
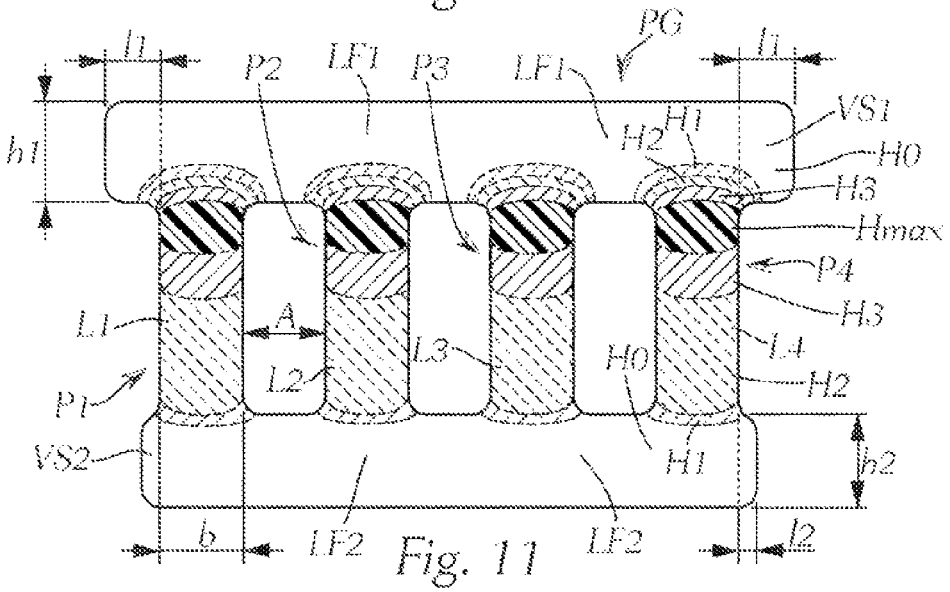
Figure 12:
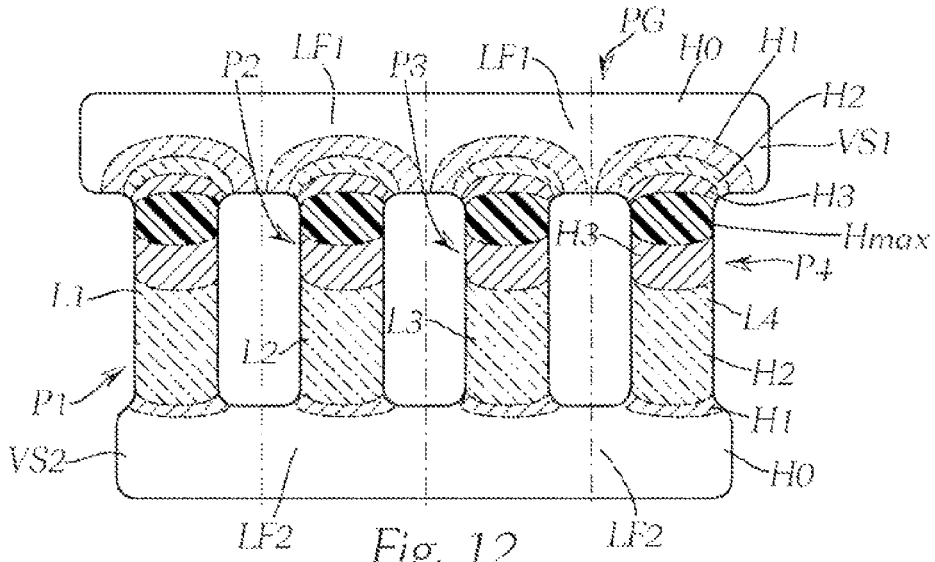
Figure 13:
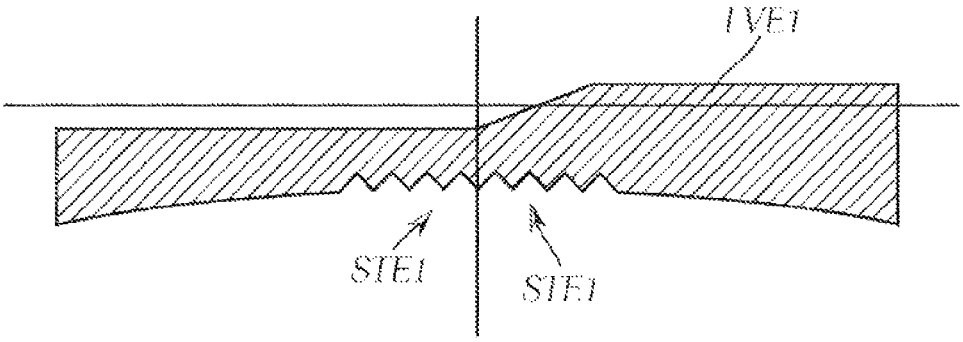
Figure 14:
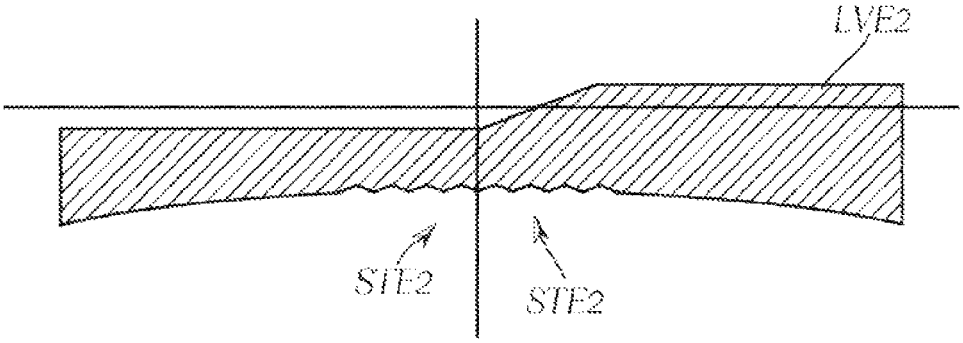
Figure 15:
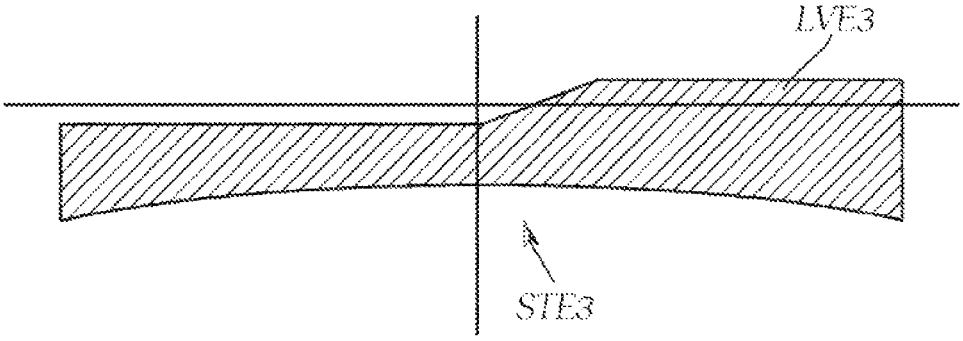

The invention is explained in greater detail in the following by reference to the drawings. Therein:

FIG. 1 shows a headlight according to the invention, comprising four LED light-source modules, FIG. 2 shows a single LED light-source module, FIG. 3 shows an exploded representation of the module from FIG. 2, FIG. 4 shows an isometric view of a first primary optical unit according to the invention, from the front, FIG. 5 shows an isometric view of the primary optical unit from the rear, FIG. 6 shows a vertical sectional view of the primary optical unit along the dash-dotted plane from FIG. 4;

FIG. 7 shows the primary optical unit from FIG. 4, in a view from above, FIG. 8 shows a vertical sectional view of a second variant of a primary optical unit, FIG. 9 shows a view of the primary optical unit from FIG. 8, from above, FIG. 10 shows an isolux distribution at the outcoupling surface/light exit surface in a primary optical unit according to the prior art (non-connected optical units), FIG. 11 shows an isolux distribution at the outcoupling surface/light exit surface according to the first embodiment of the primary optical unit, FIG. 12 shows an isolux distribution at the outcoupling surface/light exit surface according to the second embodiment, FIG. 13 shows a light distribution, produced by the use of primary optical units according to the prior art, FIG. 14 shows a light distribution, produced by the use of attachment optical units according to the first embodiment, and FIG. 15 shows a light distribution, produced by the use of attachment optical units according to the first embodiment.

FIG. 1 shows a headlight SW comprising four LED light-source modules M1-M4, e.g. an LED motor vehicle headlight SW, such as an LED motor vehicle headlight for producing a dynamic light distribution. A secondary optical element S1-S4, for example in the form of a lens, is associated with each of these LED light-source modules M1-M4 and projects the light emitted from the associated module onto the roadway.

An LED light-source module M is shown in detail in FIG. 2 and FIG. 3 and comprises two or more—four, in the example shown—LED light sources LEQ.

One LED light source LEQ, in turn, comprises at least one light-emitting diode, namely two light-emitting diodes LED1, LED2 in the example shown. One primary optical element P1-P4 is associated with the light-emitting diodes LED 1, LED 2 of each LED light source LEQ, wherein these light-emitting diodes couple light into these primary optical elements. The incoupled light then exits, at least partially, through the light exit surface L1-L4 of the primary optical element P1-P4.

The primary optical elements P1-P4 are connected to one another by means of two webs VS1, VS2, which are explained in detail further below, and form a common component, a so-called primary optical unit PG.

The LED light sources LEQ are disposed on an LED printed circuit board PRI.

The primary optical unit PG is fastened on the LED printed circuit board PRI by means of a holder HAL, and a positioning element POS is provided for positioning the primary optical unit PG relative to the LED printed circuit board.

As mentioned above, the light exit surfaces L1-L4 of the primary optical elements P1-P4 of an LED light-source module M are connected to one another by means of a light-permeable material such that light coupled into the primary optical elements P1-P4 can enter the light-permeable material and can then exit this material through the light exit surface(s) LF1, LF2 thereof.

In a specific variant of an LED light-source module, two substantially horizontally extending connecting webs VS1, VS2 made of the light-permeable material connect the primary optical elements P1-P4 to one another in the upper and lower region of the light exit surfaces L1-L4 thereof.

Due to the connection of the individual primary optical elements—the light exit surfaces of which produce the segments in the light pattern—to the light-permeable webs, the inhomogeneities in the light pattern fade into one another due to the strip formation, thereby diminishing or completely eliminating the disruptive effects in the light pattern.

The light exit surfaces L1-L4 of the primary optical elements P1-P4 and the light exit surfaces LF1, LF2 of the webs VS1, VS2 lie in a common surface.

This common surface is designed either as a plane, as shown, or is curved in accordance with the field curvature of the secondary optical elements.

A portion of the light entering a primary optical element is then no longer emitted via the light exit surface of the primary optical element itself, but rather enters the light-permeable material and exits through the light exit surface thereof. As a result, a portion of the light entering the primary optical elements blends and therefore reduces or eliminates the inhomogeneities in the light pattern. The light exiting the light-permeable material therefore contributes to the light distribution.

The primary optical elements are preferably connected to one another in the upper region in every case. The terms "upper" and "lower" refer to the state in which the module/headlight is installed in the vehicle.

This upper region is imaged via the secondary optical unit in the light pattern, below the light-dark boundary, where the unwanted inhomogeneities are the most disruptive.

These unwanted inhomogeneities are disruptive in this region because the light-distribution inhomogeneities in this region are visible on the road. The reason why the effect of inhomogeneity occurs primarily on the upper side of the primary optical unit is that the light-emitting diodes often input light asymmetrically and the light conductor opens wider downwardly than upwardly.

The expression "input light unilaterally" is intended to mean that the light is incoupled further upward and not exactly in the geometric center of the light-incoupling point of the primary optical elements.

The connection in the lower region is relatively insignificant from an optical perspective and mainly provides mechanical advantages in order to increase the stability of the entire element, which is formed of the individual primary optical elements.

Correspondingly, the upper web VS1 is significant from an optical perspective and from a mechanical perspective, while the lower web VS2 is significant mainly from a mechanical perspective.

Preferably, the connecting webs VS1, VS2 are formed as one piece with the light exit surfaces L1-L4 of the primary optical elements P1-P4 or with the primary optical elements P1-P4, i.e. the individual primary optical elements and the connecting web or the connecting webs form a single element, the so-called primary optical unit PG.

The light exit surfaces L1-L4 of the primary optical elements P1-P4 and those of the connecting webs VS1, VS2 form a common light exit surface, i.e. they form a continuous, approximately even surface, as shown.

As shown in FIG. 4, in a specific embodiment of the primary optical unit PG, the light exit surfaces L1-L4 of the primary optical elements P1-P4 are oriented upright in the vertical direction, preferably having a greater height h than width b, for example having the shape of rectangles or ellipses, etc.

By means of this upright form having a greater height and a smaller width, one light exit surface illuminates a narrow angular range in the horizontal direction, wherein, in the vertical direction, the entire region can be illuminated with this one light exit surface for this horizontal angular range.

Adjacent light exit surfaces L1-L4 of the primary optical elements P1-P4 of an LED light-source module have a normal separation A from one another, which corresponds to the width b of one light exit surface L1-L4, for example. In a specific, tested embodiment of the invention, in the case of three or more primary optical elements P1-P4, the separations A between light exit surfaces L1-L4 of adjacent primary optical elements P1-P4 are identical and, preferably, all separations between the light exit surfaces of adjacent LED light sources are identical across the entire headlight. The result thereof is a simple design having identical modules, by means of which a homogeneous light distribution can be achieved.

The exact arrangement of the individual LED light-source modules and the mode of operation is described in the patent application AT 508604 belonging to the applicant and will not be described further here.

In order to achieve optimal optical effects, the connecting webs VS1, VS2 extend upwardly (upper web VS1) and downwardly (web VS2) in the vertical direction beyond the light exit surfaces L1-L4 of the primary optical elements P1-P4 by a certain defined height h1, h2 in each case (FIG. 4).

Likewise, the connecting webs VS1, VS2 extend in the horizontal direction, laterally beyond the light exit surfaces L1-L4 of the primary optical units P1-P4 by a certain length l1, l2.

Preferably the relation h1=h2 applies.

The extension l1 in the upper region, in particular, must be selected to be so sufficient that inhomogeneities do not result from the superposition of the light patterns of the individual light modules.

For further clarification, reference is made to FIG. 5, which shows the light-incoupling points or light-incoupling surfaces LK1-LK4 in particular. These light-incoupling points can be designed level, as shown, or can have a convex and/or concave structure, i.e. a structure that collects and/or scatters light.

FIG. 6 shows a vertical sectional view along the dash-dotted line in FIG. 4 through a primary optical unit PG. As shown, the upper connecting web VS1 extends in the horizontal direction toward the rear, toward the light sources or light-emitting diodes LED1, LED2, across a certain expansion ES.

The design of the connecting web or connecting webs, in particular the extension of the connecting web or connecting webs toward the rear affects the homogeneity of the light pattern, which is also associated with a reduction of the maximum in the light distribution, i.e. the more homogeneous the light pattern is that is selected, the greater the extent is to which the maximum is reduced.

Depending on the desired effects, it is therefore provided that the extension of the at least one connecting web (VS1, VS2) downwardly/upwardly and/or the extension of the at least one connecting web (VS1, VS2) laterally beyond the light exit surfaces (L1-L4) of the primary optical elements and/or the extension of the at least one connecting web (VS1, VS2) in the horizontal direction toward the rear, in particular the extension (ES) along which the at least one connecting web (VS1, VS2) is connected to the primary optical elements (P1-P4), is/are selected such that the desired extent of homogeneity of the light pattern and the desired extent of the reduction of the maximum in the light distribution are achieved.

A plurality of LED light-source modules is used in a headlight, as described further below. Basically, these have an identical design, to the extent this is possible, and, in particular, these comprise identical primary optical elements or primary optical units (=primary optical elements connected via one or two webs). Basically it can also be provided, however, for optical reasons, that the modules, in particular the primary optical units, and, in this case in particular, the embodiment of the at least one connection web differ from one another, thereby ensuring that the desired light pattern can be adapted in an optimal manner.

The web VS2 has a similar/identical expansion, although primarily due to mechanical and/or production-related aspects, and so the optical implications will be explained by reference to the upper web VS1.

Light from the LEDs LED1, LED2 propagates in the primary optical elements (here: element P3) via total internal reflection. In order to ensure that a sufficient quantity of light can enter the light-permeable regions, i.e. the connecting web or connecting webs, it is favorable, as described above, for these to be connected to the primary optical units along a certain extension, in the sense of being contacted into one another, preferably being connected to one another, in particular as one piece.

If the connecting web would extend toward the rear across a shorter extension—see the dashed line VS1'—the light beams LS1, LS2 would not be capable of entering the web VS1 and then exiting through the light exit surface LF1 thereof, and instead would be reflected (LS1', LS2') and would exit through the light exit surface L3 of the primary optical element P3 (which is unwanted).

As shown in FIG. 7 in a view from above, the presence of the web VS1 causes the light beams (thick, solid) to be deflected away from one another in the horizontal direction, while, without the web VS1, the light beams (thin, dashed) in the primary optical element P3 would be deflected in a convergent manner in front of the light exit surface. As a result, light from different light sources/primary optical elements is mixed and, therefore, inhomogeneities that would otherwise result are obliterated.

It should be noted that the explanations presented by reference to FIGS. 6 and 7 are merely an approximate description provided to ensure a basic understanding. Actually, the effects that occur must be viewed in combination, i.e. the effect is three-dimensional.

FIG. 8 shows a variant in which the web VS1 extends toward the rear across an even greater region ES, and the upper connecting web VS1 tapers in the direction toward the light-incoupling points of the primary optical elements.

The connecting web or the extension ES thereof toward the rear reduces the maximum of the luminosity. The expansion of the extension ES toward the rear is therefore a compromise between a maximum and homogeneity. The more homogeneous the light distribution is intended to be, the greater the losses are in terms of the maximum (Hmax) of the light distribution.

The homogenization effects achieved by means of the connecting web are therefore dependent on the extent of the extension ES toward the rear. The tapering shape has no optical consequences, although this does save material. From a purely optical perspective, a cuboid shape of the connecting web would also be possible, however.

Correspondingly, light beams can enter the web VS1 even earlier, i.e. even more light enters the connecting web VS1 and then exits through the light exit surface LF1 thereof.

As shown in FIG. 9, more light also enters the regions "between" the primary optical element in this case.

FIG. 10 shows the entire light exit surface of the primary optical unit PG without connecting webs (as in the patent application AT 508604). FIG. 11 shows the light exit surface of a primary optical element PG according to FIGS. 4-7, and FIG. 12 shows a primary optical unit PG according to FIGS. 8 and 9.

Indicated therein are luminosity regions, i.e. regions having different levels of brightness (purely qualitatively, brightness=luminous flux/intensity that exits from the region), Hmax indicates a region having maximum brightness, H0 are dark regions, H1 is a region having only slight brightness, H2 is a region having (approximately) more brightness, and H3 is an even brighter region.

The light exiting these light exit surfaces is projected via the secondary optical elements onto the roadway.

The reason why the effect of inhomogenity occurs primarily on the upper side of the primary optical unit is that, as in the current variant, the light-emitting diodes often input light asymmetrically and the light conductor opens wider downwardly than upwardly. The expression "input light asymmetrically" is intended to mean that the light is incoupled further upward and not exactly in the geometric center of the light-incoupling point of the primary optical elements. Correspondingly, as shown in FIGS. 10-12, the Hmax region is located in the upper region on the outcoupling surface and not in the center.

The variant according to FIG. 10, which represents the prior art, contains no connecting webs. The exiting light distribution is imaged exactly on the outcoupling surface of the primary optical unit by means of the secondary optical unit (projection lens). In the primary optical unit shown, exactly four light fingers (four segments) are therefore produced and the intermediate spaces are filled with the light fingers of another module. Strong inhomogeneities in the superposition occur at the edges at the bottom (and the top), which cause the light pattern to bleed.

Improvements over FIG. 10 are contained in the variant according to FIG. 11 comprising a connecting web. The H1 regions of adjacent segments approach one another in the upper region in the web VS1 without actually touching one another, and the light pattern still contains inhomogeneities.

In the variant according to FIG. 12, the upper/lower region between primary optical elements P1-P4 is illuminated more intensely than is the case in the variant according to FIG. 11.

The H1 regions virtually touch one another. The superposition of the intermediate spaces with the light fingers of another module results in a homogeneous light distribution. H1 regions of adjacent light modules overlap one another virtually completely.

FIG. 13 shows a light distribution with LED light-source modules having primary optical units according to the prior art (FIG. 10). FIG. 14 shows a light distribution with LED light-source modules having primary optical units according to FIG. 11, and FIG. 15 shows a light distribution with LED light-source modules having primary optical units according to FIG. 12.

The light distribution shown is a dimmed-lighting distribution, although the effects also occur in other light distributions, such as in a high-beam lighting distribution, for example. As shown in these schematic figures, a strong inhomogeneity STE1 occurs in the light pattern LVE1 in the far field (FIG. 13). This inhomogeneity STE2 is already markedly less pronounced in the light pattern LVE2, and virtually no inhomogeneity occurs in the light pattern LVE3 (FIG. 15).

The invention claimed is:

1. An LED light-source module (M, M1-M4) for an LED motor vehicle headlight (SW) for producing a dynamic light distribution, comprising:

two or more LED light sources (LEQ), wherein one LED light source (LEQ) in each case comprises at least one light-emitting diode (LED1, LED2), and wherein the light-emitting diodes (LED1, LED2) of each LED light source (LEQ) couple light into an associated primary optical element (P1 -P4), wherein the incoupled light then exits, at least partially, through a light exit surface (L1-L4) of the primary optical element (P1-P4), wherein the light exit surfaces (L1-L4) of the primary optical elements (P1-P4) of an LED light-source module (M; M1, M2, M3, M4) are disposed next to one another with horizontal separation (A) that forms a void between each of the light exit surfaces (L1-L4) of the primary optical elements (P1-P4) and at least one substantially horizontally extending connecting web (VS 1, VS2) made of a light-permeable material connects the primary optical elements (P1-P4) in an upper and/or lower region of the light exit surfaces (L1-L4) thereof, but not within the void between each of the light exiting surfaces (L1-L4), to maintain the horizontal separation (A) and void between the light exit surfaces (L1-L4), such that light coupled into the primary optical elements (P1-P4) can enter the light-permeable material of the at least one connecting web (VS 1, VS2) and then exit the light-permeable material through a light exit surface (LF1, LF2) of the at least one connecting web (VS 1, VS2).

2. The LED light-source module according to claim 1, wherein the light exit surfaces (L1-L4) of the primary optical elements (P1-P4) lie in a common surface, and the light exit surface (LF1, LF2) of the light-permeable material also lies in the common surface of the light exit surfaces of the primary optical elements.

3. The LED light-source module according to claim 1, wherein the light exit surfaces (L1-L4) of the primary optical elements (P1-P4) are connected to one another in an upper and/or lower region.

4. The LED light-source module according to claim 1, wherein two substantially horizontally extending connecting webs (VS 1, VS2) made of the light-permeable material connect the primary optical elements (P1-P4) to one another in the upper and lower region of the light exit surfaces (L1-L4) thereof.

5. The LED light-source module according to claim 1, wherein the at least one connecting web (VS 1, VS2) is formed as one piece with the light exit surfaces (L1-L4) of the primary optical elements (P1-P4) or with the primary optical elements (P1-P4).

6. The LED light-source module according to claim 1, wherein the light exit surfaces (L1-L4) of the primary optical elements (P1-P4) and those of the at least one connecting web (VS1-VS2) form a common light exit surface.

7. The LED light-source module according to claim 1, wherein the at least one connecting web (VS 1, VS2) extends upwardly/downwardly in the vertical direction beyond the light exit surfaces (L1-L4) of the primary optical elements (P1 -P4) by a certain height (h1, h2).

8. The LED light-source module according to claim 1, wherein the at least one connecting web (VS1, VS2) extends in the horizontal direction, laterally beyond the light exit surfaces (L1-L4) of the primary optical elements (P1-P4) by a certain length (11, 12).

9. The LED light-source module according to claim 1, wherein the at least one connecting web (VS1, VS2) extends in the horizontal direction toward the rear in the direction of the light sources (LEQ) and is connected to the primary optical elements (P1-P4) along a certain extension (ES).

10. The LED light-source module according to claim 9, wherein the at least one connecting web (VS1) tapers in the direction of the light-incoupling points (LK1-LK4) of the primary optical elements (P1-P4).

11. The LED light-source module according to claim 1, wherein the primary optical elements (P1-P4) expand from the light-incoupling points (LK1-LK4) thereof toward the light exit surfaces (L1-L4), wherein the primary optical elements (P1-P4) expand to a greater extent in the downward extension thereof than in the upward extension thereof.

12. The LED light-source module according to claim 1, wherein the light exit surfaces (L1-L4) of the primary optical elements (P1-P4) are rectangular.

13. The LED light-source module according to claim 1, wherein all the light exit surfaces (L1-L4) have an identical shape.

14. The LED light-source module according to claim 1, wherein the light exit surfaces (L1-L4) of the primary optical elements (P1-P4) are disposed parallel to one another and with identical orientation.

15. The LED light-source module according to claim 1, wherein a secondary optical unit (S1, S2, S3, S4) is associated with the LED light-source module (M; M1, M2, M3, M4), and wherein, when the headlight (SW) is installed in a vehicle, the secondary optical unit images the light segments produced by the light exit surfaces (L1-L4) of the primary optical elements (P1-P4) in a region located in front of the vehicle.

16. The LED light-source module according to claim 1, wherein the light exit surfaces (L1-L4) are oriented upright in the vertical direction, having a greater height (h) than width (b).

17. The LED light-source module according to claim 1, wherein adjacent light exit surfaces (L1-L4) of the primary optical elements (P1-P4) of an LED light-source module (M; M1, M2, M3, M4) have a normal separation (A) from one another, which corresponds to the width (B) of one light exit surface (L1-L4).

18. The LED light-source module according to claim 1, wherein, in the case of three or more primary optical elements (P1-P4), the separations (A) between light exit surfaces (L1-L4) of adjacent primary optical elements (P1-P4) are identical.

19. The LED light-source module according to claim 1, wherein the extension of the at least one connecting web (VS1, VS2) downwardly/upwardly and/or the extension of the at least one connecting web (VS1, VS2) laterally beyond the light exit surfaces (L1-L4) of the primary optical elements and/or the extension of the at least one connecting web (VS1, VS2) in the horizontal direction toward the rear is/are selected such that the desired extent of homogeneity of the light pattern and the desired extent of the reduction of the maximum in the light distribution are achieved.

20. An LED motor vehicle headlight (SW) for producing a dynamic light distribution, comprising:

two or more LED light-source modules (M; M1, M2, M3, M4) according to claim 1, wherein a secondary optical unit (51, S2, S3, S4) is associated with each of the LED light-source modules (M; M1, M2, M3, M4), and wherein, when the headlight (SW) is installed in a vehicle, the secondary optical unit images the light segments produced by the light exit surfaces (L1-L4) of the primary optical elements (P1-P4) in a region located in front of the vehicle.

21. The headlight according to claim 20, wherein the secondary optical elements (S1, S2, S3, S4) of the LED light-source modules (M; M1, M2, M3, M4) and the arrangement of the light exit surfaces (L1-L4) of the primary optical elements are matched to one another such that the light segments from the individual LED light-source modules (M; M1, M2, M3, M4) are imaged such that the light segments are offset relative to one another in the horizontal direction, and wherein the individual LED light sources can be controlled separately.

22. The headlight according to claim 20, wherein the individual LED light-source modules (M; M1, M2, M3, M4) comprise identical secondary optical elements (Si, S2, S3, S4).

23. The headlight according to claim 20, wherein all separations (A) between light exit surfaces (L1-L4) of adjacent LED light sources are identical across the entire headlight.

24. The headlight according to claim 20, wherein an overall arrangement of the light exit surfaces (L1-L4) of an LED light-source module (M; M1, M2, M3, M4) assumes a defined position in the horizontal direction relative to the optical axis (X) of the secondary optical element (Si, S2, S3, S4), and wherein the different overall arrangements of the individual LED light-source modules (M; M1, M2, M3, M4) have defined positions differing from one another in the horizontal direction relative to the optical axis of the particular secondary optical element (S1, S2, S3, S4) associated therewith.

25. The headlight according to claim 20, wherein the light exit surfaces of all LED light-source modules (M; M1, M2, M3, M4) of the headlight are each disposed on one side of a vertical plane through the optical axis of the particular secondary optical unit (S1, S2, S3, S4) associated therewith.

26. The headlight according to claim 20, wherein exactly one light exit surface of all light exit surfaces of a headlight intersects the optical axis of the secondary optical unit associated therewith.

27. The headlight according to claim 20, wherein one LED light source (LQE) comprises at least two light-emitting diodes (LED1, LED2) disposed horizontally over one another, wherein these light-emitting diodes (LED1, LED2) can be controlled independently of one another, and wherein each of the at least two light-emitting diodes (LED1, LED2) is imaged via the light exit surface of the primary optical element as horizontal light segments within the vertical light segment imaged by the primary optical element.

28. The headlight according to claim 20, wherein each light-emitting diode of an LED light source can be controlled separately.

29. A vehicle headlight system comprising:

two headlights (SW) according to claim 20, wherein the headlight that is installed in the vehicle on the left produces the left part of the light distribution on a roadway, and the right headlight produces the right part of the light distribution, and wherein at least each LED light source can be controlled separately.

30. The LED light-source module of claim 10, wherein the upper connecting web (VS1) tapers in the shape of a wedge in the direction of the light-incoupling points (LK1-LK4) of the primary optical elements (P1-P4).

31. The LED light-source module of claim 19, wherein the extension (ES) along which the at least one connecting web (VS1, VS2) is connected to the primary optical elements (P1-P4) is selected such that the desired extent of homogeneity of the light pattern and the desired extent of the reduction of the maximum in the light distribution are achieved.

32. The vehicle headlight system of claim 29, wherein each light-emitting diode of the two headlights can be controlled separately.

* * * * *